US005226838A

United States Patent [19]

Hsu

[11] Patent Number: 5,226,838

[45] Date of Patent: Jul. 13, 1993

[54] T-SHAPED COAXIAL CONNECTOR

[76] Inventor: Cheng S. Hsu, No. 285, Kaishan Rd., Tainan, Taiwan

[21] Appl. No.: 972,745

[22] Filed: Nov. 6, 1992

[51] Int. Cl.[5] ..... H01R 9/07

[52] U.S. Cl. ..... 439/582; 439/579; 439/654

[58] Field of Search ..... 439/578–585, 439/675, 394, 650–654

[56] References Cited

U.S. PATENT DOCUMENTS

| | | | |
|---|---|---|---|
| 3,461,419 | 8/1969 | Link | 439/394 |
| 4,746,307 | 5/1988 | Joly et al. | 439/394 |
| 4,775,329 | 10/1988 | Verhoeven | 439/394 |
| 4,795,356 | 1/1989 | Pauza | 439/578 |
| 5,030,122 | 7/1991 | Birch et al. | 439/579 |

*Primary Examiner*—David Pirlot

*Attorney, Agent, or Firm*—Webb, Burden, Ziesenheim & Webb

[57] ABSTRACT

A T-shaped coaxial connector includes a T-shaped housing consisting of a longitudinal housing portion and a vertical housing portion, a socket member, two side-terminal protectors of insulating material, a plug protector, and a plug. The socket member has two side terminals, an aperture on an upper surface thereof, and a key being formed on both sides of the socket member. The side-terminal protectors are mounted on the side terminals in which a keyway on each side-terminal protector engages with the respective key on the socket member. Each side-terminal protector has an flat upper surface and the longitudinal housing portion has an inner downward-facing surface such that the socket member is prevented from rotational movement with respect to the longitudinal housing portion. The plug protector is received in the vertical housing portion and includes a lower engaging end for engaging with slots formed in the upper surface of the side-terminal protectors. The plug is received in the plug protector with a lower end thereof engaging with an aperture in the the socket member to form an electrical connection.

1 Claim, 3 Drawing Sheets

T-SHAPED COAXIAL CONNECTOR

BACKGROUND OF THE INVENTION

The present invention relates to a T-shaped coaxial connector and, more particularly, to a T-shaped axial connector which provides a simple and reliable structure for assembling.

Conventional coaxial connectors are costly and inefficient in assembling. Sometimes the connector itself is damaged during the assembly. The present invention provides an improved T-shaped coaxial connector to mitigate and/or obviate the aforementioned problems.

SUMMARY OF THE INVENTION

A T-shaped coaxial connector in accordance with the present invention includes a T-shaped housing consisting of a longitudinal housing portion and a vertical housing portion, a socket member, two side-terminal protectors of insulating material, a plug protector of insulating material, and a plug. The socket member has a base, a side terminal extending from both sides of the base, an aperture on an upper surface of the base, and a key is formed on both sides of the base. The side-terminal protectors are mounted on the side terminals in which a keyway on each side-terminal protector engages with respective key on the socket member. Each side-terminal protector has a flat upper surface and the longitudinal housing portion has an inner downward-facing surface such that the socket member, when received in the longitudinal housing portion, is prevented from rotational movement with respect to the longitudinal housing portion. The plug protector is received in the vertical housing portion and includes a lower engaging end for engaging with slots formed in the upper surface of the side-terminal protectors. The plug is received in the plug protector with a lower end thereof engaging with an aperture in the socket member to form an electrical connection.

Other advantages and novel features of the invention will become more apparent from the following detailed description when taken in conjunction with the accompanying drawings.

DETAILED DESCRIPTION OF THE PREFERRED EMBODIMENTS

Figure 4:
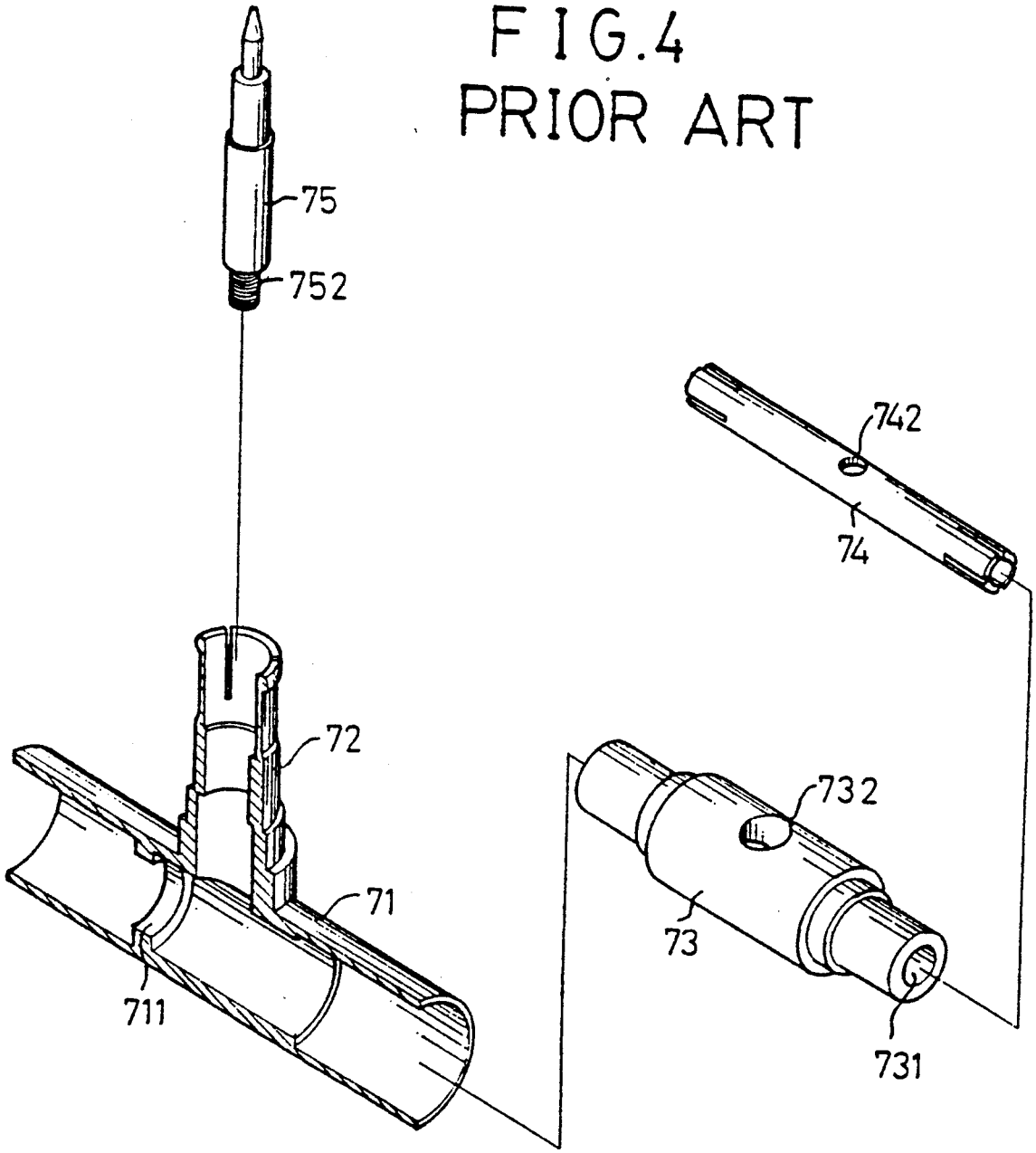
FIG.4 PRIOR ART
FIG. 4 is an exploded view, partly in section, of a T-shaped coaxial connector according to prior art.

For a better understanding of the present invention, reference is made to FIG. 4 showing a conventional T-shaped coaxial connector which includes a T-shaped housing consisting of a longitudinal housing portion 71 and a vertical housing portion 72, an insulating tube 73 received in the longitudinal housing portion 71, a two-end socket 74 received in the insulating tube 73, and a plug 75 received in the vertical housing portion 72. When assembling, the two-end socket 74 is inserted into the insulating tube 73 with the hole 742 in the two-end socket 74 in alignment with the hole 732 in the insulating tube 73. Thereafter, the insulating tube/two-end socket 73/74 is inserted into the longitudinal housing portion 71 via a right opening 731 of the latter until the former is stopped by a flange 711 in the latter. Subsequently, the plug 75 is inserted into the vertical housing portion 72 for engaging the threaded end 752 of the former with the hole 742 of the two-end socket 74, thereby providing an electrical connection.

Nevertheless, when inserting the insulating tube/two-end socket 73/74 into the longitudinal housing portion 71, undesired rotational movement of the former relative to the latter often occurs, such that the former has to be taken out and re-inserted again, which is time-wasting and inefficient. Furthermore, since the diameter of the vertical housing portion 72 is quite small while the plug 75 is short, an additional tool, such as pliers, are applied to hold and rotate the plug 75 so as to proceed with a threading connection between the lower threaded end 752 of the plug 75 and hole 742. Such an operation is cumbersome and sometimes causes damage to the threading connection which affects the conductivity.

Figure 1:
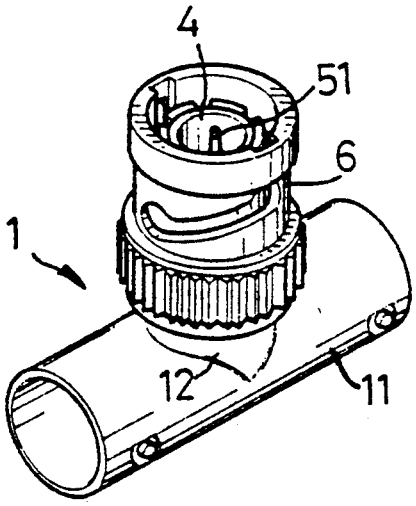
FIG. 1 is a perspective view of a T-shaped coaxial connector in accordance with the present invention.
Figure 3:
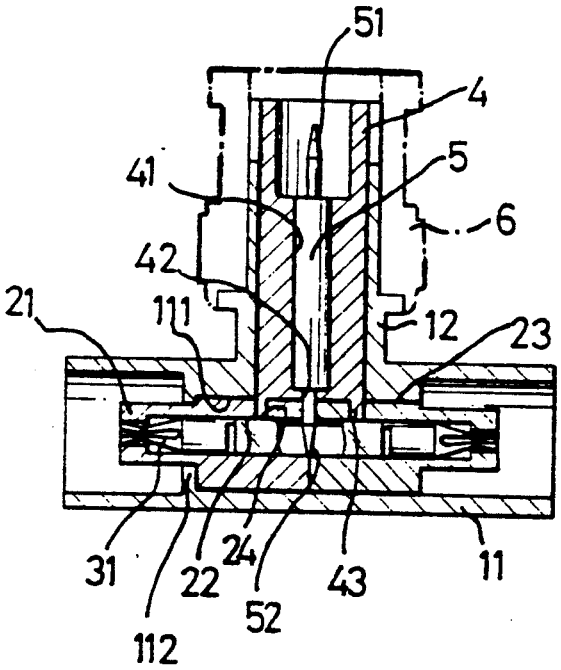
FIG. 3 is a cross-sectional view of the T-shaped coaxial connector in accordance with the present invention.
Figure 2:
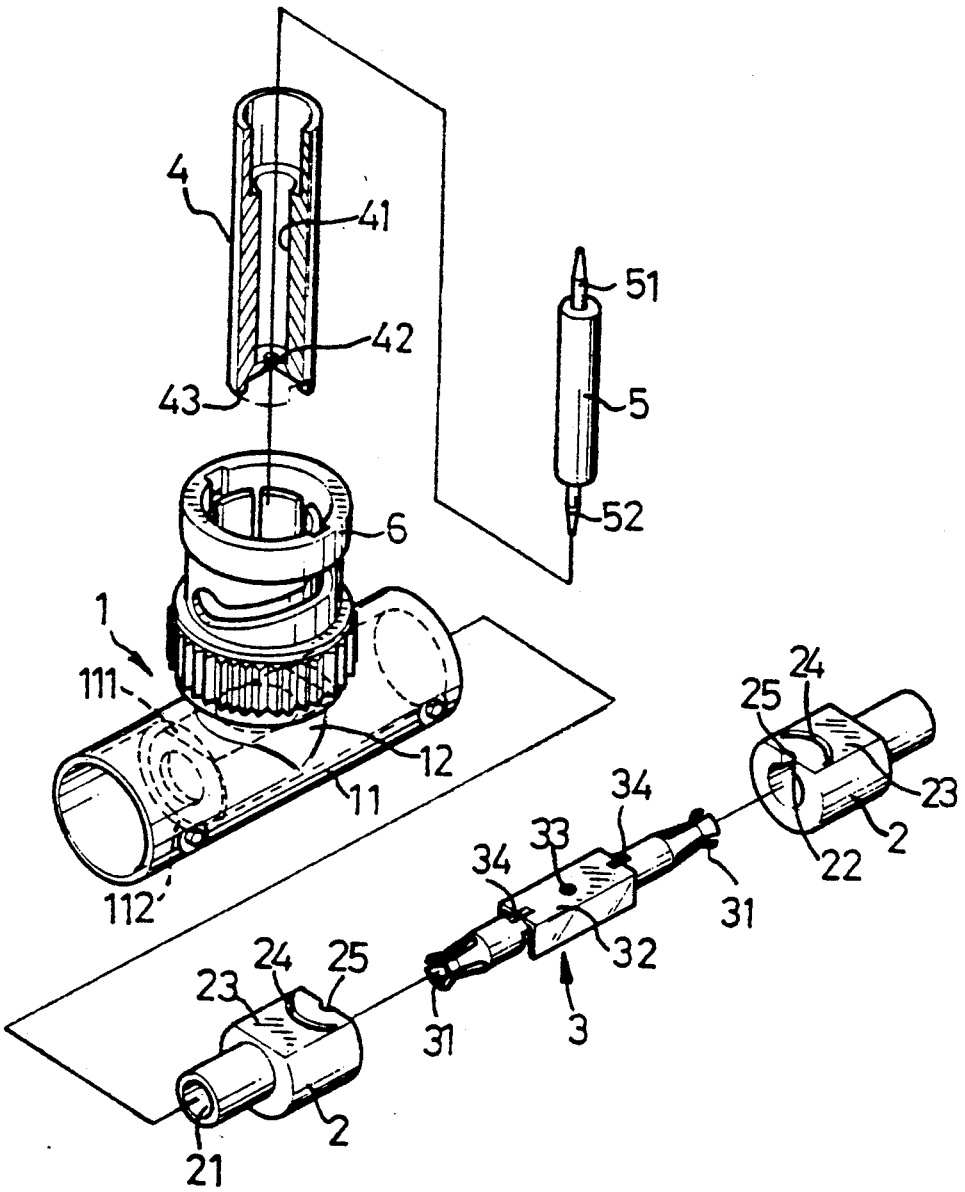
FIG. 2 is an exploded view of the T-shaped coaxial connector in accordance with the present invention.

To overcome the above-mentioned drawbacks, the present invention provides an improved T-shaped coaxial connector which is clearly illustrated in FIGS. 1 through 3. The T-shaped coaxial connector in accordance with the present invention generally includes a substantially T-shaped housing consisting of a longitudinal housing portion 11 and a vertical housing portion 12, a socket member 3, two side-terminal protector 2 of insulating material each for respectively protecting a side terminal 31 of the socket member 3, a plug protector 4 of insulating material received in the vertical housing portion 12, and a plug 5 received in the plug protector 4 with an end 52 thereof engaging with an aperture 33 in the socket member 31. The socket member 3 includes a substantially rectangular base 32, a side terminal 31 extending from both sides of the base, a key 34 on both sides of the base 32, and an aperture 33 in an upper surface of the base 32.

When assembling, the two side-terminal protectors 2 are mounted onto the side terminals 31 of the socket member 3 to protect the terminal 31, in which a keyway 25 in each side-terminal protector 2 receives a respective key 34 on the socket member 3. Thereafter, the socket member 3 together with the side-terminal protectors 2 are inserted into the longitudinal housing portion 11 until it is stopped by a flange 112 in the latter. The flat upper surfaces 23 of the side-terminal protectors 2 contact an inner downward-facing flat surface 111 of the longitudinal housing portion 11, thereby preventing the socket member 3 from rotational movement with respect to the longitudinal housing portion 11. Then, inserting the plug protector 4 into the vertical housing portion 12, with a lower end thereof engaging with a slot 24 formed in the upper surface 23 of each side-terminal protector 2 and is thus held in position. Subsequently, the plug 5 is inserted through the vertical protector 4 to engage with an aperture 33 in the socket member 3. As can be seen in FIGS. 2 and 3, the plug protector 4 has an inner passage 4 which allows the plug 5 to pass through and a neck 42 on which the plug 5 rests. Referring to FIG. 3, when inserting the plug 5, it further press the plug protector 4 downward to insure the engagement between the lower engaging end 43 of the plug protector 4 and the slot 24.

According to the above description, it is appreciated that the T-shaped coaxial connector in accordance with the present invention provides a quick and reliable assembly. It is further appreciated that the inner flat surface 111 in the longitudinal housing portion 11 may be formed in another way, i.e., it can be upward-facing, etc. And the side-terminal protectors 2 have corresponding flat surfaces to contact therewith.

Although the invention has been explained in relation to its preferred embodiment, it is to be understood that many other possible modifications and variations can be made without departing from the spirit and scope of the invention as hereinafter claimed.

I claim:

1. A T-shaped coaxial connector comprising:

a substantially T-shaped housing consisting of a longitudinal housing portion and a vertical housing portion, said longitudinal housing portion having an inner flat surface and an inner flange for positioning;

a socket member having a base and a side terminal extending from each of two sides of said base, an aperture being formed in an upper surface of said base, and a key being formed on both sides of said base;

two side-terminal protectors of insulating material each having a keyway for engaging with respective said key on said socket member, each said side-terminal protector having a flat surface for engaging with said inner flat surface of said longitudinal housing portion for preventing rotational movement of said socket member with respect to said longitudinal housing portion, a slot being formed on an upper surface of each said side-terminal, said socket member and said side-terminal protector being positioned by said inner flange and said inner flat surface when received in said longitudinal housing portion;

a plug protector of insulating material received in said vertical housing portion, comprising a lower engaging end for engaging with said slots in said socket member, an inner passage, and a neck formed in said inner passage; and a plug received in said inner passage and rested on said neck with a lower end thereof in engagement with said aperture in said socket member to form an electrical connection.

* * * * *